US008067141B2

(12) United States Patent
Yamaguchi et al.

(10) Patent No.: US 8,067,141 B2
(45) Date of Patent: Nov. 29, 2011

(54) ELECTROGRAPHIC CARRIER, DEVELOPER, DEVELOPING METHOD, IMAGE FORMING APPARATUS, AND PROCESS CARTRIDGE

(75) Inventors: Kimitoshi Yamaguchi, Shizuoka (JP); Naoki Imahashi, Shizuoka (JP); Masashi Nagayama, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 566 days.

(21) Appl. No.: 11/897,999

(22) Filed: Aug. 31, 2007

(65) Prior Publication Data

US 2008/0063969 A1 Mar. 13, 2008

(30) Foreign Application Priority Data

Sep. 14, 2006 (JP) ..... 2006-248969
Aug. 22, 2007 (JP) ..... 2007-215384

(51) Int. Cl.
*G03G 9/113* (2006.01)

(52) U.S. Cl. ..... 430/110.2; 430/110.4

(58) Field of Classification Search ..... 430/110.2, 430/110.4

See application file for complete search history.

(56) References Cited

U.S. PATENT DOCUMENTS

| | | | | |
|---|---|---|---|---|
| 4,076,640 | A | 2/1978 | Forgensi et al. | |
| 5,288,577 | A | 2/1994 | Yamaguchi et al. | |
| 5,419,994 | A * | 5/1995 | Honjo et al. | 430/111.35 |
| 6,124,067 | A * | 9/2000 | Mikuriya et al. | 430/100 |
| 6,146,801 | A * | 11/2000 | Ichikawa et al. | 430/111.35 |
| 6,735,409 | B2 | 5/2004 | Takahashi et al. | |
| 6,743,558 | B2 | 6/2004 | Yamaguchi et al. | |
| 7,192,679 | B2 | 3/2007 | Yamaguchi et al. | |
| 2003/0224279 | A1 | 12/2003 | Kotsugai et al. | |
| 2005/0064315 | A1 | 3/2005 | Yamaguchi et al. | |
| 2005/0158643 | A1 | 7/2005 | Yamaguchi et al. | |
| 2006/0057487 | A1 | 3/2006 | Nagayama et al. | |
| 2006/0210905 | A1 | 9/2006 | Imahashi et al. | |
| 2007/0048652 | A1 | 3/2007 | Imahashi et al. | |

FOREIGN PATENT DOCUMENTS

| | | |
|---|---|---|
| EP | 0 434 253 A | 6/1991 |
| JP | 51-107281 | 9/1976 |
| JP | 58-144839 | 8/1983 |
| JP | 1-21504 | 4/1989 |

(Continued)

OTHER PUBLICATIONS

Machine English Langauge translation of JP 2005-215397 Aug. 2005.*

(Continued)

*Primary Examiner* — Hoa Le
(74) *Attorney, Agent, or Firm* — Cooper & Dunham LLP

(57) ABSTRACT

A carrier is provided including a core and a resin layer located overlying the core, wherein the carrier has a weight average particle diameter (Dw) of from 22 to 50 μm, a ratio (Dw/Dp) of the weight average particle diameter (Dw) to a number average particle diameter (Dp) of from 1 to 1.30, a shape factor SF-1 of from 100 to 120, and a shape factor SF-2 of from 100 to 120, and wherein the carrier comprises core particles satisfying the following relationship $0.52<(d/D)<1.0$ in an amount of from 0 to 10,000 ppm by number: wherein D (μm) represents a diameter of a circle having the same area as that of a projected image of a core particle and d (μm) represents a diameter of a circle having the same area as that of a projected image of a maximum hollow present in the core particle.

8 Claims, 7 Drawing Sheets

FOREIGN PATENT DOCUMENTS

| | | | |
|---|---|---|---|
| JP | 2-223962 | | 9/1990 |
| JP | 11 139827 | A | 5/1999 |
| JP | 3039180 | | 2/2000 |
| JP | 3078828 | | 6/2000 |
| JP | 2005-524249 | | 8/2005 |
| JP | 2005215397 | * | 8/2005 |
| JP | 3726592 | | 10/2005 |
| JP | 2006-39445 | | 2/2006 |

OTHER PUBLICATIONS

Machine English Langauge translation of JP 2006-039445 Feb. 2006.*

European Patent Office, European Search Report dated Jan. 31, 2008 for European Patent Application No. 07115631.9-1217 (Ricoh Company, Ltd.).

U.S. Appl. No. 11/736,351(claims and drawings).

* cited by examiner

| GRANULARITY (AT LIGHTNESS 65) | IMAGE SAMPLE |
|---|---|
| 9 | |
| 8 | |
| 7 | |
| 6 | |
| 5 | |
| 4 | |
| 3 | |
| 2 | |

ELECTROGRAPHIC CARRIER, DEVELOPER, DEVELOPING METHOD, IMAGE FORMING APPARATUS, AND PROCESS CARTRIDGE

BACKGROUND OF THE INVENTION

1. Field of the Invention

The present invention relates to an electrophotographic carrier and a developer using the carrier. In addition, the present invention relates to a developing method, an image forming apparatus, and a process cartridge using the developer.

2. Discussion of the Related Art

Developing methods for use in electrophotography are classified into a one-component developing method using a one-component developer consisting essentially of a toner and a two-component developing method using a two-component developer including a toner and a carrier such as a glass bead, a magnetic carrier, and a coated carrier, the surface of which is coated with a resin, etc.

Since the two-component developing method uses a carrier, which typically has a wide surface area so as to triboelectrically charge a toner, the two-component developing method has advantages over the one-component developing method in view of providing stable charging ability and producing high quality images for a long period of time. In addition, the two-component developing method has a high ability to feed a toner to the developing area. Therefore, the two-component developing method is widely used for digital electrophotographic systems in which an electrostatic latent image is formed on a photoreceptor by a laser beam and then made visible.

In order to respond to recent demands for improving resolution, highlight reproducibility and uniformity (granularity) of images, and colorization of images, a minimum unit composing a latent image, i.e., a dot, is modified to be much smaller and denser. There is a need for a developing system which can faithfully develop the latent image (i.e., dots), and various attempts have been made from aspects of improving both image forming process and developer (i.e., a toner and a carrier). From the aspect of image forming process, techniques of narrowing the developing gap, thinning layers of the photoreceptor, and making the diameter of the writing beam smaller are effective, but these techniques still have disadvantages of high cost and poor reliability.

On the other hand, from the aspect of developer, dot reproducibility is largely improved by using a toner having a small particle diameter. However, there is a problem that a developer including a toner having a small particle diameter tends to produce images with low image density and fog in that the background portion of an image is soiled with toner particles. When the toner is a full-color toner, a binder resin having a low softening point is typically used. Such a toner tends to adhere to the carrier, compared to a monochrome toner, and to deteriorate properties of the developer. As a result, toner scattering and fog in the background are easily caused.

Carriers having a small particle diameter have been also proposed.

For example, published unexamined Japanese Patent Application No. (hereinafter referred to as JP-A) 58-144839 discloses a magnetic carrier including a particulate ferrite having a spinel structure, and having an average particle diameter of less than 30 μm. Since this carrier is not covered by a resin and used for low electric field, the developed mass per area is poor and the life is short.

Japanese Patent No. (hereinafter referred to as JP) 3029180 discloses a carrier having a 50% average particle diameter (D50) of from 15 to 45 μm, and including carrier particles having a particle diameter of less than 22 μm in an amount of from 1 to 20%, carrier particles having a particle diameter of less than 16 μm in an amount of not greater than 3%, carrier particles having a particle diameter of not less than 62 μm in an amount of from 2 to 15%, and carrier particles having a particle diameter of not less than 88 μm in an amount of not greater than 2%, and further having a specific surface area.

Such a carrier having a small particle diameter has the following advantages.

(1) The surface area per unit volume is large. Therefore, the carrier is able to satisfactorily give charge to toner particles by friction, and therefore insufficiently-charged toner particles and reversely-charged toner particles are hardly produced. As a result, fog hardly occurs in the background and toner particles hardly scatter and blur, resulting in producing images with good dot reproducibility.

(2) For the above reason, the resultant image has high image density.

(3) Dense magnetic brushes can be formed. Since such a magnetic brush has good fluidity, the resultant image hardly has a brush mark.

On the other hand, spherical carriers, which have stable charging ability and are capable of producing uniform images, have been proposed. For example, JP 3078828 discloses a carrier including core particles which are spheroidized by a plasma treatment. Published Japanese translation of PCT international patent application No. 2005-524249 discloses a method for forming spherical particles from irregular particles by a plasma treatment.

However, as the particle diameter of a carrier decreases, the magnetic binding force thereof drastically decreases at a rate of cube of the particle diameter. As a result, a carrier particle or a cut magnetic brush tends to deposit on a latent image (this phenomenon is hereinafter referred to as "carrier deposition"), and make scratches on a photoreceptor or a fixing roller.

SUMMARY OF THE INVENTION

Accordingly, an object of the present invention is to provide a carrier having a cover layer in which the cover layer is hardly abraded, resulting in providing stable charging ability.

Another object of the present invention is to provide a developer including a spherical carrier and a toner in which the toner is hardly adhered to the carrier owing to its spherical shape, resulting in decreasing the occurrence of fog in the background.

Yet another object of the present invention is to provide a developing method, an image forming apparatus, and a process cartridge capable of producing images having good uniformity (i.e., granularity) without causing the carrier deposition.

These and other objects of the present invention, either individually or in combinations thereof, as hereinafter will become more readily apparent, can be attained by a carrier, comprising:

a core; and a resin layer located overlying the core, wherein the carrier has a weight average particle diameter (Dw) of from 22 to 50 μm, a ratio (Dw/Dp) of the weight average particle diameter (Dw) to a number average particle diameter (Dp) of from 1 to 1.30, a shape factor SF-1 of from 100 to 120, and a shape factor SF-2 of from 100 to 120, and wherein the carrier comprises core particles satisfying the following relationship (1) in an amount of from 0 to 10,000 ppm by number:

$$0.52<(d/D)<1.0 \quad (1)$$

wherein D (μm) represents a diameter of a circle having the same area as that of a projected image of a core particle and d (μm) represents a diameter of a circle having the same area as that of a projected image of a maximum hollow present in the core particle;

and a developer, a developing method, an image forming apparatus, and a process cartridge using the carrier.

BRIEF DESCRIPTION OF THE DRAWINGS

These and other objects, features and advantages of the present invention will become apparent upon consideration of the following description of the preferred embodiments of the present invention taken in conjunction with the accompanying drawings, wherein.

DESCRIPTION OF THE PREFERRED EMBODIMENTS

Figure 1:
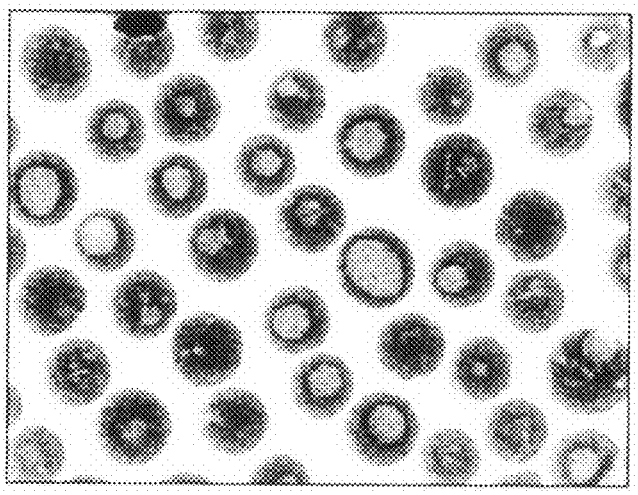
FIG. 1 is an X-ray microscope photograph of core particles including hollows.

To achieve the objects, the present invention contemplates the provision of a carrier having a small average particle diameter, a specific particle diameter distribution such that a small amount of particles having very small particle diameters are included, a nearly spherical shape, and a smooth surface, with control of the amount of hollows having a specific size present in the core of the carrier.

In order to prepare a core having a small average particle diameter, a nearly spherical shape, and a smooth surface, a method including melting a core material and spheroidizing the melted core material in a gas phase is very effective.

As an example of such a method, there can be mentioned a gas burner method, a flame spraying method (disclosed in JP-A 2-223962), a high-frequency plasma method and a hybrid plasma method (disclosed in JP 3078828), a gas burner method (disclosed in Canadian Patent No. 838061) including fixing a wire rod to a gas burning gun, introducing and burning a high-pressure mixture gas of acetylene and oxygen, and melting and spraying the wire rod to prepare spherical particles, and a method (disclosed in JP-A 51-107281) including introducing raw ore particles to a carbon arc heating device providing a plasma flame, and melting and spraying the raw ore particles to form spherical particles, the disclosures of all these documents being incorporated herein by this reference.

A carrier using a core prepared by the above methods has the following advantages:

(1) it is capable of producing images having good granularity;

(2) a torque of a developing sleeve, a transport screw, etc. can be reduced compared to a carrier having a rough surface;

(3) a cover layer covering the core is hardly abraded; and (4) a toner is hardly adhered to the carrier.

However, there is a drawback that such a carrier tends to cause the carrier deposition even if the magnetization (emu/g) of the carrier is increased.

Generally, the carrier deposition in that a carrier particle or a cut magnetic brush is deposited on an image or the background of the image occurs when the following relationship is satisfied:

$$Fm<Fc$$

wherein Fm represents the magnetic binding force and Fc represents the carrier deposition causing force.

The present inventors made analysis of carriers having a small particle diameter which are prepared by a method including melting a core material and spheroidizing the melted core material in a gas phase, and found out that carrier particles including a large hollow therein tend to cause the carrier deposition.

A carrier particle having a large hollow has a small weight for its volume, and therefore the magnetization per particle is small. On the other hand, the surface area of the carrier particle is substantially the same regardless of the presence or absence of the hollow. Therefore, the amount of the countercharge of a toner given to the carrier particle and that of an induced charge are also same regardless of the presence or absence of the hollow. For the above reason, the above relationship is satisfied and the carrier deposition is caused.

It is considered that the hollows present in carrier particles are formed by the following reasons.

(1) When a core is spheroidized, an inert gas or a fuel gas dissolves in a melted core metal and remains in the core when solidified.

(2) When particles are united, hollows are formed.

The hollows present in core particles can be quantified by the following method, for example.

The diameter D (μm) of a circle having the same area as that of a projected image of a core particle and the diameter d (μm) of a circle having the same area as that of a projected image of a maximum hollow present in the core particle can be determined under the following conditions.

Measurement instrument: X-ray microscope (TUX-3000W from Tohken Co., Ltd.)

Tube voltage: 46 kV

Tube current: 200 μA

Focus size: 0.6 μm

Images of 2,000 particles of a core are photographed using the above instrument, and then the diameters D (μm) and d (μm) are calculated with an image processing software Image-Pro PLUS Ver 4.0 (from Media Cybernetics, Inc.).

FIG. 1 is an X-ray microscope photograph of core particles including hollows.

Figure 2:
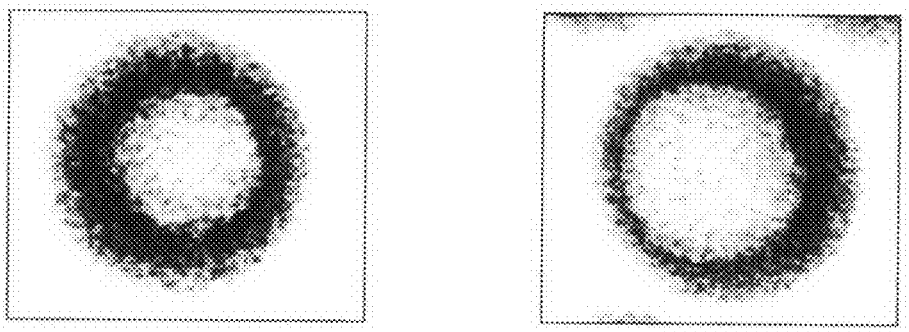
FIG. 2 is a magnification image of a X-ray microscope photograph of core particles including hollows.

FIG. 2 is a magnification image of a X-ray microscope photograph of core particles including hollows.

Figure 3:
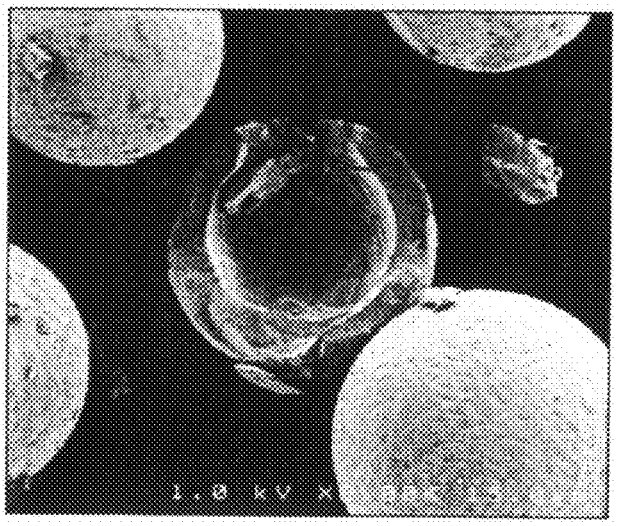
FIG. 3 is a scanning electron microscope image of core particles including hollows, which is cracked by a physical force.

FIG. 3 is a scanning electron microscope image of core particles including hollows, which is cracked by a physical force.

Figure 4:
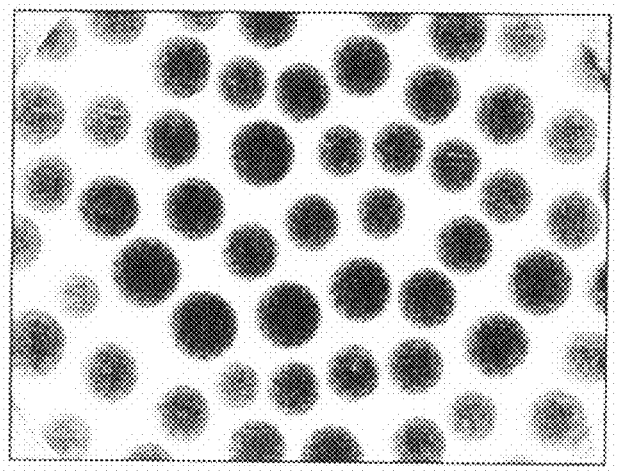
FIG. 4 is an X-ray microscope photograph of core particles including few hollows.

FIG. 4 is an X-ray microscope photograph of core particles including few hollows.

The diameters D (μm) and d (μm) are defined by the following equations:

$$D=2\times(A/\pi)^{1/2}$$

$$d=2\times(a/\pi)^{1/2}$$

wherein A ($\mu m^2$) represents the area of a projected image of a core particle and a ($\mu m^2$) represents the area of a projected image of a maximum hollow present in the core particle.

The present inventors found out that the ratio (d/D) has a relationship with the occurrence of fog in the background of the resultant image. In particular, by controlling the ratio (d/D), variations in magnetization between each of the core particles can be reduced.

The carrier of the present invention includes a core having magnetic properties and a resin layer located overlying the core.

The carrier of the present invention has a weight average particle diameter (Dw) of from 22 to 50 μm, and preferably from 22 to 45 μm. When the Dw is too large, the carrier deposition hardly occurs, but the latent image cannot be faithfully developed with a toner, and therefore each of the dot diameters varies. As a result, granularity of the resultant image deteriorates. When the toner concentration is high, fog easily occurs in the background. As mentioned above, the carrier deposition is a phenomenon in that carrier particles deposit on the image portion and the background portion of a latent image. At a portion where the electric field is strong in an image, the carrier easily deposits thereon. In the image portion, the electric field strength is decreased when the latent image is developed with a toner. Therefore, the carrier deposition hardly occurs in the solid image compared to the background.

The carrier of the present invention has the ratio (Dw/Dp) of the weight average particle diameter (Dw) to the number average particle diameter (Dp) of from 1 to 1.30, and preferably from 1 to 1.25. When the ratio (Dw/Dp) is too large, the carrier includes too large an amount of ultrafine particles, and therefore the carrier deposition easily occurs. When the ratio (Dw/Dp) satisfies the above range, the carrier has a narrow particle diameter distribution and the occurrence of defect in the trailing end, i.e., the last portion of the image that passes the magnetic brush, can be prevented. This is because that magnetic brush can be uniformly formed.

As the particle diameters of carrier particles decrease, the frictional force between each of the carrier particles increases, resulting in deterioration of fluidity of the carrier particles. As a result, the torque of the developing sleeve increases. When a carrier has a spherical shape and a smooth surface, in other words, when a carrier has an SF-1 of from 100 to 120 and an SF-2 of from 100 to 120, the developing torque decreases, the cover layer is hardly abraded, and the deterioration in toner charge per unit mass can be decreased. In addition, a toner hardly adheres to such a spherical carrier, resulting in decreasing the occurrence of fog in the background.

When the SF-1 is too large, the carrier has an irregular shape far from a sphere. When the SF-2 is too large, the surface of the carrier is roughened and has large concavities and convexities. In these cases, the torque of the developing sleeve increases, a toner easily adheres to the carrier, and the toner charge per unit mass decreases. As a result, fog easily occurs in the background.

The core for use in the carrier of the present invention has a weight average particle diameter of from 22 to 50 μm and the ratio (Dw/Dp) of the weight average particle diameter (Dw) to the number average particle diameter (Dp) of from 1 to 1.30. In order to obtain a core having an SF-1 of from 100 to 120 and an SF-2 of from 100 to 120, a method including melting a core material and spheroidizing the melted core material in a gas phase is very effective.

When the Dw is too large, the carrier deposition hardly occurs, but the latent image cannot be faithfully developed with a toner, and therefore each of the dot diameters varies. As a result, granularity of the resultant image deteriorates. When the toner concentration is high, fog easily occurs in the background.

The core has a ratio (Dw/Dp) of the weight average particle diameter (Dw) to the number average particle diameter (Dp) of from 1 to 1.30, and more preferably from 1 to 1.25. When the ratio (Dw/Dp) is too large, the core includes too large an amount of ultrafine particles, and therefore the carrier deposition easily occurs.

As the particle diameters of core particles decrease, the frictional force between each of the core particles increases. As a result, the torque of the developing sleeve increases. When a core has a spherical shape and the surface thereof is smoothened, in other words, when a core has an SF-1 of from 100 to 120 and an SF-2 of from 100 to 120, the developing torque decreases, the cover layer is hardly abraded, and the deterioration in toner charge per unit mass can be decreased. In addition, a toner hardly adheres to such a spherical carrier, resulting in decreasing the occurrence of fog in the background.

When the SF-1 is too large, the core has an irregular shape far from a sphere. When the SF-2 is too large, the surface of the core is roughened and has large concavities and convexities. In these cases, the torque of the developing sleeve increases, a toner easily adheres to the carrier, and the toner charge per unit mass decreases. As a result, fog easily occurs in the background.

Further, the carrier of the present invention includes core particles satisfying the following relationship (1) in an amount of from 0 to 10,000 ppm by number, and more preferably from 0 to 3,000 ppm by number:

$$0.52<(d/D)<1.0 \quad (1)$$

wherein D (μm) represents a diameter of a circle having the same area as that of a projected image of a core particle and d (μm) represents a diameter of a circle having the same area as that of a projected image of a maximum hollow present in the core particle.

When a core particle satisfies the relationship d/D=0.52, the core particle has a weight about 14% smaller than that including no hollow. As a result, the magnetization per particle decreases in an amount of about 14%, and therefore the binding force to the developing sleeve decreases.

In other words, when the carrier includes core particles having a magnetization 14% or more smaller than that including no hollow (i.e., core particles satisfying 0.52<(d/D)<1.0) in an amount of greater than 10,000 ppm by number, the carrier deposition easily occurs.

When the carrier includes such core particles in an amount of less than 3,000 ppm by number, the resultant image has good granularity without the occurrence of fog in the background and the carrier deposition.

In the present invention, the weight average particle diameter (Dw) of a carrier, a core, a toner is determined based on the particle diameter distribution measured on the number basis, and is defined by the following equation:

$$Dw=\{1/\Sigma(nD^3)\}\times\{\Sigma(nD^4)\}$$

wherein D (μm) represents a representative diameter of a channel and n represents the number of particles present in the channel.

In this regard, a "channel" is defined as a unit length (width) dividing the particle diameter range into a measurement unit, in a particle diameter distribution diagram. In the present invention, the unit length is 2 μm.

As the representative diameter of a channel, the minimum diameter in the channel is adopted.

In the present invention, the number average particle diameter (Dp) of a carrier and a core is determined based on the particle diameter distribution measured on the number basis, and is defined by the following equation:

$$Dp=(1/N)\times(\Sigma nD)$$

wherein D (μm) represents a representative (i.e., the minimum) diameter of a channel, n represents the number of particles present in the channel, and N represents the total number of measured particles.

The particle diameter distribution of a carrier is measured using an instrument MICROTRAC HRA9320-X100 (from Honeywell International Inc.). The measurement conditions are as follows.

Particle diameter range: 100 to 8 μm
Channel length (width): 2 μm
Channel number: 46
Refractive index: 2.42

As mentioned above, the carrier of the present invention has an SF-1 of from 100 to 120 and an SF-2 of from 100 to 120. It is more preferable that the carrier of the present invention has an SF-1 of from 100 to 110 and an SF-2 of from 100 to 110.

When a carrier has a nearly spherical shape and a smooth surface (i.e., having small convexities and concavities), a uniform magnetic brush can be formed in the developing area, and therefore the carrier deposition hardly occurs.

If a carrier has a rough surface (i.e., having large convexities and concavities), the thickness of the resin cover layer varies by location. Such a carrier has nonuniform charging ability and resistance, and therefore durability of the carrier deteriorates with time and the carrier deposition easily occurs.

The shape factors SF-1 and SF-2 are determined by the following method, for example:

(1) 100 randomly selected carrier particles are photographed using a scanning electron microscope (S-800, manufactured by Hitachi Ltd.) at a magnification of 300 times; and (2) photographed images of carrier particles are analyzed using an image analyzer (LUZEX AP manufactured by Nireco Corp.) via an interface to determine the SF-1 and SF-2.

The SF-1 and SF-2 are defined by the following equations:

$$SF\text{-}1=(L^2/A)\times(\pi/4)\times100$$

$$SF\text{-}2=(P^2/A)\times(\pi/4\pi)\times100$$

wherein L represents the diameter of the circle circumscribing the image of a carrier particle, P represents the peripheral length of the image of a carrier particle, and A represents the area of the image of a carrier particle.

The shape factor SF-1 represents the degree of the roundness of a particle, and the shape factor SF-2 represents the degree of the concavity and convexity of a particle.

When the SF-1 is 100, the particle has a true spherical form. When the SF-1 is larger than 100, the particle has an irregular form. When the SF-2 approaches 100, the particle has a smooth surface (i.e., the particle has few concavity and convexity). When the SF-2 is large, the particle is roughened.

The present inventors have found out that when a core having a magnetization of not less than 40 emu/g, preferably not less than 70 emu/g, when 1,000 oersted (Oe) of a magnetic field is applied, is used, the occurrence of the carrier deposition can be decreased. The upper limit of the magnetization is not particularly limited, but typically about 150 emu/g. Unless otherwise specified, all values of magnetization herein are values of magnetization when a field of 1,000 Oe is used (i.e., values of magnetization at 1 KOe). When the magnetization of the core is too small the carrier deposition easily occurs.

Specific examples of the materials used for the core includes any known magnetic materials.

The magnetization can be measured as follows, for example:

(1) a cylindrical cell is charged with 1.0 g of a core, and then the cell is set in a B-H tracer (BHU-60 from Riken Denshi Co., Ltd.);

(2) a magnetic field is gradually increased to 3,000 Oe, and then gradually decreased to 0;

(3) a magnetic field having the reverse direction is gradually increased to 3,000 Oe, and then gradually decreased to 0; and (4) a magnetic field having the reverse direction (same as the first direction) is applied again.

Thus, a B-H curve is obtained. A magnetization observed when 1,000 Oe of a magnetic field is applied is determined from the B-H curve.

Specific examples of the cores having a magnetization of not less than 40 emu/g when 1,000 Oe of a magnetic field is applied include, but are not limited to, ferromagnets such as cobalt, magnetite, hematite, Li ferrite, Mn—Zn ferrite, Cu—Zn ferrite, Ni—Zn ferrite, Ba ferrite, and Mn ferrite.

The ferrite is typically a sintered material having the following formula:

$$(MO)_x(NO)_y(Fe_2O_3)_z$$

wherein each of M and N independently represents Ni, Cu, Zn, Li, Mg, Mn, Fe, Sr, or Ca; and the sum of x, y, and z is 100 (% by mol).

Namely, the ferrite is a complete mixture of divalent metal oxides and a trivalent iron oxide.

The ferrite may optionally include an additive such as Si, Ti, Ta, Nb, and V; and an alkali earth metal such as Ca.

Specific examples of the cores having a magnetization of not less than 70 emu/g when 1,000 Oe of a magnetic field is applied include, but are not limited to, magnetite, Mn—Mg—Sr ferrite, and Mn ferrite.

The carrier of the present invention preferably includes a core obtained by melting a core material and spheroidizing the melted core material in a gas phase.

As an example of such a method, the following methods are preferably used: a method (disclosed in JP-A 51-107281) including introducing raw ore particles to a carbon arc heating device providing a plasma flame, melting the raw ore particles to form spheroidized droplets thereof, and allowing the spheroidized droplets to fall by gravity; a flame spraying method (disclosed in JP-A 02-223962) including melting a raw material in a burning flame of propane (serving as a fuel gas), oxygen (serving as an assistance gas), and nitrogen (serving as a raw material transport gas), and spraying the melted material into water to form spherical particles; a gas burner method; a burning flame gas method; a high-frequency plasma method and a hybrid plasma method (disclosed in JP 3078828) including charging an irregular-shaped iron powder into a plasma generated in a container under a reduced pressure of from 30 to 100 Torr to form spherical particles; a direct current arc plasma method; a method (disclosed in published examined Japanese Patent Application No. 01-21504, incorporated herein by this reference) including passing a high current through a wire rod fixed to a gas burning gun so that the wire rod is discharge-melted, spraying the melted material by introducing a high-pressure nitrogen gas, and atomizing the material into water to form spherical particles; and a method (disclosed in published Japanese translation of PCT international patent application No. 2005-524249, incorporated herein by this reference) including providing ferrite feed materials in a form of particles having different sizes and irregular shapes, and exposing the ferrite feed materials to a plasma to provide a more spherical shape to irregularly shaped particles to thereby make the ferrite powder.

The core can be prepared by ferritizing spheroidized particles, or spheroidizing ferritized particles.

When a spherical core having a smooth surface is prepared by the above methods, hollows may be formed therein. The reason why hollows are formed is considered as follows.

(1) Raw material particles (which are not spheroidized) potentially have a lot of hollows. Once such raw material particles are melted, the particles tend to solidify from the outer region. Therefore, the hollows tend to migrate to the inner region and form large hollows in the resultant core particles.

(2) A gas used in a thermal treatment is immersed in raw material particles. For the same reason mentioned above, large hollows are formed in the inner region of the resultant core particles.

(3) A large hollow formed in the process of preparing ferrite particles or forming spherical particles remains or grows in the resultant core particles.

In order not to form a large hollow in the process of melting a core material and spheroidizing the melted core material in a gas phase, the core material (i.e., raw material) is preferably previously pulverized into fine particles.

In the present invention, spheroidized core particles having a large hollow therein are removed by a combination of a classification using an ultrasonic vibration sieve and a magnetic separation method.

A core material such as a ferromagnet and a ferrite (ferrimagnet) develops a magnetization proportional to the mass thereof when a magnetic field is applied. Therefore, the core material is bound by the magnetic field. In the magnetic separation method, particles having a small magnetization, i.e., particles having a small mass due to the presence of hollows, can be separated using the difference of the binding force of the magnetic field. If the particles have a wide particle diameter distribution, a relatively large amount of particles having a small mass (without hollows) are present. Therefore, in order to efficiently remove particles having hollows, it is preferable that the particles are previously classified before subjected to the magnetic separation method.

The number of particles having a large hollow can be controlled by the combination of the classification and the magnetic separation method. As mentioned above, since a core particle satisfying the relationship d/D=0.52 has a weight about 14% smaller than that including no hollow, such core particles can also be classified using wind power, especially when the core particles have a uniform shape and a narrow particle diameter distribution. In addition, since a core particle satisfying the relationship d/D=0.52 has a magnetization (emu) about 14% smaller than that including no hollow, such core particles can also be classified using magnetic force because of having small magnetic binding force.

Further, the following methods and combinations thereof for removing hollows can also be used to control the number of particles having a large hollow: melting and spheroidizing a core material under a reduced pressure; preliminarily dissolving and removing impurities causing a gas; and rapidly cooling a core material so as not to allow hollows present in the material to migrate in the inner region.

The developer of the present invention, including a toner and the carrier of the present invention, preferably has an absolute value of the toner charge per unit mass of from 10 to 50 μC/g, and more preferably from 15 to 35 μC/g, when the developer includes the toner in an amount of 7% by weight. Such a developer hardly causes fog in the background and the carrier deposition.

The developer of the present invention, including a toner and the carrier of the present invention, preferably includes the toner in an amount of from 2 to 20% by weight, and more preferably 3 to 15% by weight, based on total weight of the developer.

When the absolute value of the toner charge per unit mass is less than 10 μC/g, fog in the background and toner scattering easily occur. When the absolute value of the toner charge per unit mass is greater than 50 μC/g, the carrier deposition easily occurs. When the absolute value of the toner charge per unit mass is less than 35 μC/g, the carrier deposition hardly occurs.

The toner charge per unit mass can be measured by the following method, for example.

Figure 5:
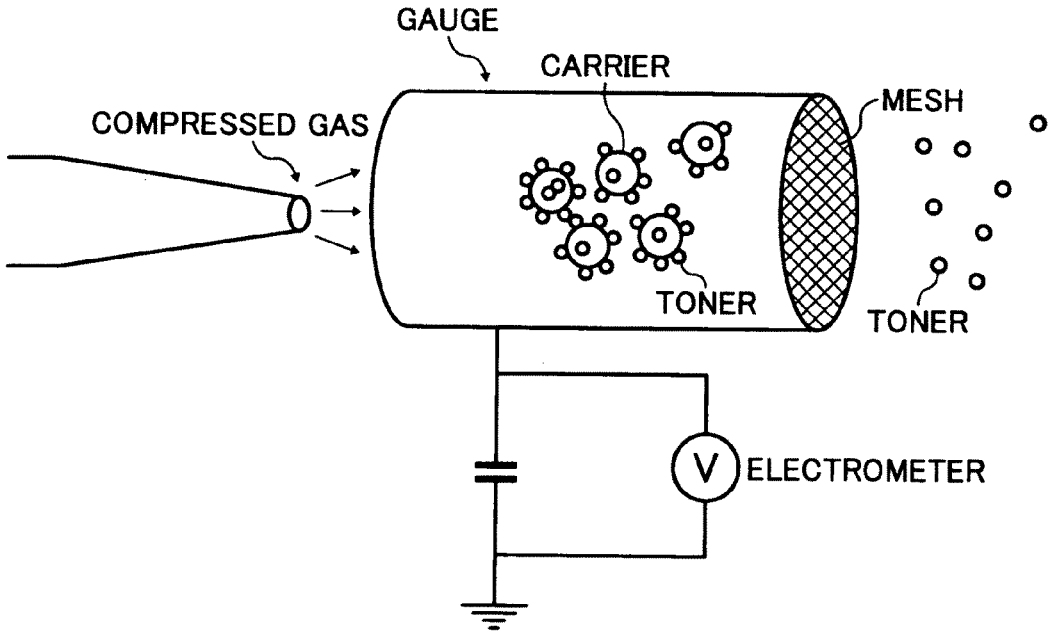
FIG. 5 is a schematic view for explaining how to measure the toner charge per unit mass in the present invention.

FIG. 5 is a schematic view for explaining how to measure the toner charge per unit mass in the present invention.

A specific amount of a developer is contained in a conductive container (gauge), both ends of which are equipped with a metallic mesh. The mesh (which is stainless) has openings (20 μm) larger than the particle diameter of a toner and smaller than that of a carrier so that the toner can pass through the mesh. A compressed gas is blown from a nozzle at a pressure of 1 kgf/cm$^2$ for 60 seconds so that the toner is blown off from the gauge. As a result, the carrier having the opposite charge polarity from the toner remains in the gauge. The charge Q of the carrier and the weight M of the blown-off toner are measured, and then the charge quantity per unit weight (Q/M) is calculated. The value of Q/M (μC/g) is treated as the toner charge per unit mass.

The toner for use in the developer of the present invention preferably has a weight average particle diameter of from 3.0 to 9.0 μm, and more preferably from 3.0 to 5.0 μm. When such a toner is used in combination with the carrier of the present invention, high quality images having good granularity can be produced.

The carrier of the present invention preferably has a resistivity (Log R·Ωcm) of from 11.0 to 16.0, and more preferably from 12.0 to 14.0.

When the resistivity is too small, a charge is induced to the carrier when the developing gap (i.e., the minimum distance between the photoreceptor and the developing sleeve) is small, resulting in the occurrence of the carrier deposition. Further, when the linear speeds of the photoreceptor and the developing sleeve are large, the carrier deposition easily occurs. Moreover, when an AC bias is applied, the carrier deposition notably occurs. Typically, a carrier used for a full-color developer has a relatively low resistivity so that a sufficient amount of a toner can be developed.

A carrier having the above resistivity can produce images having a high image density when a toner has a proper toner charge per unit mass.

When the resistivity is too large, the charge having the opposite polarity from the toner tends to accumulate on the carrier. As a result, the carrier deposition easily occurs.

Figure 6:
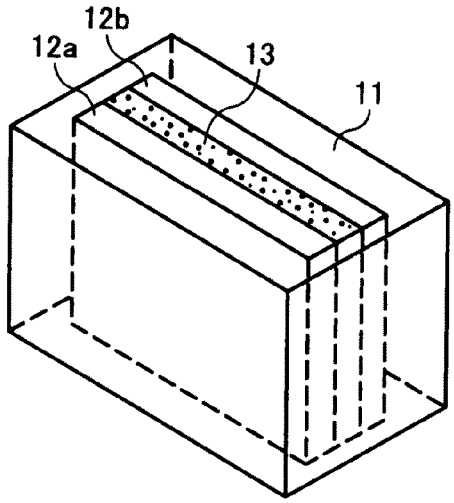
FIG. 6 is a schematic view for explaining how to measure the resistivity of a carrier in the present invention.

FIG. 6 is a schematic view for explaining how to measure the resistivity of a carrier in the present invention.

A pair of electrodes 12*a* and 12*b* having a distance of 2 mm and a surface area of 2×4 $cm^2$ is contained in a cell 11 made of a fluorocarbon resin. The cell 11 is filled with a carrier 13, and then 100 V of a direct-current voltage is applied to the electrodes. A direct-current resistance is measured with a high resistance meter 4329A+LJK 5HVLVWDQFH OHWHU (from Yokogawa-Hewlett-Packard Company), and then the electrical resistivity (Log R·Ωcm) is calculated.

The cell 11 is filled with the carrier 13 as follows. At first, the carrier 13 is poured to the brim of the cell 11, and then the cell 11 is tapped for 20 times. The upper surface of the cell 11 is scraped once with a non-magnetic spatula so that brimming carriers are removed. There is no need to apply a pressure when the cell 11 is filled with the carrier 13.

The resistivity of a carrier can be controlled by varying the resistance and thickness of a resin cover layer located on a core. In addition, a conductive powder can be added to the resin cover layer. Specific examples of the conductive powders include, but are not limited to, metal and metal oxide powders (e.g., conductive ZnO, Al), $SnO_2$ which are prepared by various methods, $SnO_2$ which is doped with various elements, borides (e.g., $TiB_2$, $ZnB_2$, $MOB_2$), silicon carbide, conductive polymers (e.g., polyacetylene, polyparaphenylene, poly(paraphenylene sulfide), polypyrrole, polyaniline), and carbon blacks (e.g., furnace black, acetylene black, channel black).

The conductive powder can be uniformly dispersed in a solvent used for coating or a resin layer coating liquid by using a dispersing machine such as a ball mill and a bead mill, or an agitating machine equipped with blade rotating at high speeds.

Any known resins can be used for the cover layer of the carrier of the present invention, and are not particularly limited. In particular, silicone resins including the following repeating units are preferably used:

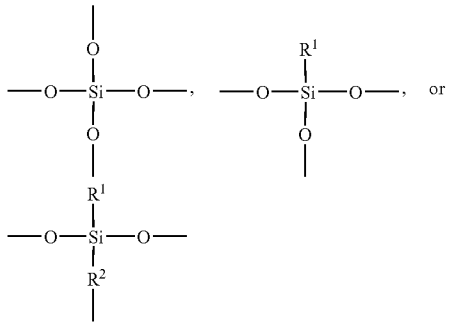

wherein $R^1$ represents a hydrogen atom, a halogen atom, a hydroxyl group, a methoxy group, a lower alkyl group having 1 to 4 carbon atoms, or an aryl group (e.g., phenyl group, tolyl group); and $R^2$ represents an alkylene group having 1 to 4 carbon atoms or an arylene group (e.g., phenylene group).

The aryl group preferably has 6 to 20, more preferably 6 to 14, carbon atoms. Specific examples of the aryl groups include aryl groups derived from benzene (such as phenyl group); those derived from condensed polycyclic aromatic hydrocarbons such as naphthalene, phenanthrene, and anthracene; and those derived from chain polycyclic aromatic hydrocarbons such as biphenyl and terphenyl.

The aryl group may have a substituent group.

In the present invention, straight silicone resins can be used as the silicone resin. Specific examples of useable commercially available straight silicone resins include, but are not limited to, KR271, KR272, KR282, KR252, KR255, and KR152 (from Shin-Etsu Chemical Co., Ltd.); and SR2400 and SR2406 (from Dow Corning Toray Silicone Co., Ltd.).

In the present invention, modified silicone resins can be also used as the silicone resin. Specific examples of the modified silicone resins include, but are not limited to, epoxy-modified silicone resin, acryl-modified silicone resin, phenol-modified silicone resin, urethane-modified silicone resin, polyester-modified silicone resin, and alkyd-modified silicone resin.

Specific examples of useable commercially available modified silicone resins include, but are not limited to, ES1001N (epoxy-modified), KR5208 (acryl-modified), KR5203 (polyester-modified), KR206 (alkyd-modified), and KR305 (urethane-modified) (from Shin-Etsu Chemical Co., Ltd.); and SR2115 (epoxy-modified) and SR2110 (alkyd-modified) (from Dow Corning Toray Silicone Co., Ltd.).

Further, the following resins can be used in combination with the silicone resin: styrene resins such as polystyrene, chloropolystyrene, poly(α-methylstyrene), styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylate copolymers (e.g., styrene-methyl acrylate copolymer, styrene-ethyl acrylate copolymer, styrene-butyl acrylate copolymer, styrene-octyl acrylate copolymer, styrene-phenyl acrylate copolymer), styrene-methacrylate copolymers (e.g., styrene-methyl methacrylate copolymer, styrene-ethyl methacrylate copolymer, styrene-butyl methacrylate copolymer, styrene-phenyl methacrylate copolymer), styrene-methyl α-chloroacrylate copolymer, and styrene-acrylonitrile-acrylate copolymer; and other resins such as epoxy resin, polyester resin, polyethylene resin, polypropylene resin, ionomer resin, polyurethane resin, ketone resin, ethylene-ethyl acrylate resin, xylene resin, polyamide resin, phenol resin, polycarbonate resin, melamine resin, and fluorocarbon resin.

The cover layer can be formed on a core by any known methods such as a spray dry method, a dipping method, and a powder coating method.

A fluidized bed coating device is effective for forming a uniform cover layer.

The cover layer typically has a thickness of from 0.02 to 1 μm, and preferably from 0.03 to 0.8 μm.

The cover layer including the silicone resin may include an aminosilane coupling agent. Thereby, the carrier has good durability.

The cover layer preferably includes the aminosilane coupling agent in an amount of from 0.001 to 30% by weight.

Specific examples of the aminosilane coupling agents include the following compounds, but are not limited thereto:

$H_2N(CH_2)_3Si(OCH_3)_3$ (Mw=179.3)

$H_2N(CH_2)_3Si(OCH_2H_5)_3$ (Mw=221.4)

$H_2NCH_2CH_2CH_2Si(CH_3)_2(OCH_2H_5)$ (Mw=161.3)

$H_2NCH_2CH_2CH_2Si(CH_3)(OCH_2H_5)_2$ (Mw=191.3)

$H_2NCH_2CH_2NHCH_2Si(OCH_3)_3$ (Mw=194.3)

$H_2NCH_2CH_2NHCH_2CH_2CH_2Si(CH_3)(OCH_3)_2$ (Mw=206.4)

$H_2NCH_2CH_2NHCH_2CH_2CH_2Si(OCH_3)_3$ (Mw=224.4)

$(CH_3)_2NCH_2CH_2CH_2Si(CH_3)(OCH_2H_5)_2$ (Mw=219.4)

$(C_4H_9)_2NC_3H_6Si(OCH_3)_3$ (Mw=291.6)

(Toner)

The toner for use in the present invention includes a binder resin mainly composed of a thermoplastic resin, and a colorant, a charge controlling agent, a release agent, etc. are dispersed therein. Any known toners such as a polymerization toner and a pulverization toner, which may have a spherical or an irregular shape, can be used. Both magnetic toners and non-magnetic toners can be used.

Specific examples of the binder resins of the toner include, but are not limited to, styrene resins such as homopolymers of styrene and derivatives thereof (e.g., polystyrene, polyvinyl toluene) and styrene copolymers (e.g., styrene-p-chlorostyrene copolymer, styrene-propylene copolymer, styrene-vinyl toluene copolymer, styrene-methyl acrylate copolymer, styrene-ethyl acrylate copolymer, styrene-butyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-vinyl methyl ketone copolymer, styrene-butadiene copolymer, styrene-isoprene copolymer, styrene-maleic acid copolymer, styrene-maleate copolymer); acrylic resins (e.g., polymethyl methacrylate, polybutyl methacrylate); and other resins such as polyvinyl chloride, polyvinyl acetate, polyethylene, polypropylene, polyester, polyurethane, epoxy resin, polyvinyl butyral, polyacrylic acid resin, rosin, modified rosin, terpene resin, phenol resin, aliphatic hydrocarbon resin, aromatic petroleum resin, chlorinated paraffin, and paraffin wax. These can be used alone or in combination.

The polyester resin has lower melt-viscosity compared to the styrene or acrylic resins while keeping preservation stability. The polyester resin can be formed from a polycondensation reaction between an alcohol and a carboxylic acid.

Specific examples of the alcohol for preparing a polyester resin include, but are not limited to, diols (e.g., polyethylene glycol, diethylene glycol, triethylene glycol, 1,2-propylene glycol, 1,3-propylene glycol, 1,4-propylene glycol, neopentyl glycol, 1,4-butenediol), 1,4-bis(hydroxymethyl)cyclohexane, bisphenol A, hydrogenated bisphenol A, etherified bisphenol A (e.g., polyoxyethylenated bisphenol A, polyoxypropylenated bisphenol A), these divalent alcohols substituted with a saturated or unsaturated hydrocarbon group having 3 to 22 carbon atoms, and other divalent alcohols; and polyols having 3 or more valences (e.g., sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Specific examples of the carboxylic acid for preparing a polyester resin include, but are not limited to, monocarboxylic acids (e.g., palmitic acid, stearic acid, oleic acid); maleic acid, fumaric acid, mesaconic acid, citraconic acid, itaconic acid, terephthalic acid, cyclohexane dicarboxylic acid, succinic acid, adipic acid, sebacic acid, malonic acid, these divalent organic acids substituted with a saturated or unsaturated hydrocarbon group having 3 to 22 carbon atoms, dimers of an acid anhydride or a lower alkyl ester thereof and linolenic acid, and other divalent organic acids; and polycarboxylic acid monomers having 3 or more valences such as 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, and acid anhydrides thereof.

The epoxy resin can be formed from a polycondensation reaction between bisphenol A and epichlorohydrin. Specific examples of useable commercially available epoxy resins include, but are not limited to, EPOMIK® R362, R364, R365, R366, R367, and R369 (from Mitsui Chemicals, Inc.); EPOTOHTO®YD-011, YD-012, YD-014, YD-904, and YD-017 (from Tohto Kasei CO., Ltd.); and EPIKOTE® 1002, 1004, and 1007 (from Shell Kagaku K. K.).

Specific examples of the colorant for use in the toner include, but are not limited to, carbon black, lamp black, iron black, ultramarine blue, Nigrosine dyes, Aniline Blue, Phthalocyanine Blue, HANSA YELLOW G, Rhodamine 6G Lake, chalco oil blue, chrome yellow, quinacridone, benzidine yellow, rose bengal, triarylmethane dyes, and monoazo and disazo dyes and pigments. These can be used alone or in combination.

The toner may optionally include a magnetic material. Specific examples of the magnetic materials include, but are not limited to, powders of ferromagnets (e.g., iron, cobalt), magnetite, hematite, Li ferrite, Mn—Zn ferrite, Cu—Zn ferrite, Ni—Zn ferrite, and Ba ferrite.

In order to sufficiently control the triboelectric chargeability of the toner, the toner may include a charge controlling agent such as metal complex salts of monoazo dyes, nitrohumic acid and salts thereof, amino compounds of metal complexes of salicylic acid, naphthoic acid, and dicarboxylic acid with Co, Cr, Fe, etc., quaternary ammonium salts, and organic dyes.

The toner may optionally include a release agent, if desired. Specific examples of the release agents include, but are not limited to, low-molecular-weight polypropylene, low-molecular-weight polyethylene, carnauba wax, microcrystalline wax, jojoba wax, rice wax, and montanic acid wax. These can be used alone or in combination.

An external additive can be added to the toner so as to impart fluidity. It is important for a toner to have good fluidity so as to produce high quality images.

As the external additive, particulate inorganic materials and hydrophobized particulate inorganic materials can be used. The toner preferably includes a hydrophobized particulate inorganic material having an average particle diameter of from 1 to 100 nm, preferably from 5 to 70 nm, and a specific surface area of from 200 to 500 $m^2/g$ determined by BET method.

Specific examples of the external additives include, but are not limited to, silica, hydrophobized silica, metal salts of fatty acids (e.g., zinc stearate, aluminum stearate), metal oxides (e.g., titania, alumina, tin oxide, antimony oxide), and fluoropolymers.

Among these, particles of silica, titania (titanium oxide), and alumina, which are hydrophobized, are preferably used. Specific examples of useable commercially available hydrophobized silicas include, but are not limited to, HDK H 2000, HDK H 2000/4, HDK H 2050EP, HVK 21, and KDK H 1303 (from Clariant Japan K. K.); and R972, R974, RX200, RY200, R202, R805, and R812 (from Nippon Aerosil Co., Ltd.). Specific examples of useable commercially available hydrophobized titanias include, but are not limited to, P-25 (from Nippon Aerosil Co., Ltd.); STT-30 and STT-65C-S (from Titan Kogyo K. K.); TAF-140 (from Fuji Titanium Industry Co., Ltd.); MT-150W, MT-500B, MT-600B, and MT-150A (from Tayca Corporation); T-805 (from Nippon Aerosil Co., Ltd.); STT-30A, and STT-65S-S (from Titan Kogyo K. K.); TAF-500T and TAF-1500T (from Fuji Titanium Industry Co., Ltd.); MT-100S and MT-100T (from Tayca Corporation); and IT-S (from Ishihara Sangyo Kaisha, Ltd.).

A hydrophilic inorganic material (such as silica, titania, alumina) can be hydrophobized by treating the hydrophilic inorganic material with a silane coupling agent such as methyl trimethoxysilane, methyl triethoxysilane, and octyl trimethoxysilane.

The toner for use in the present invention preferably has a weight average particle diameter (Dt) of from 3.0 to 9.0 μm, and more preferably from 3.0 to 5.0 μm. The particle diameter is measured using COULTER COUNTER (from Beckman Coulter K. K.).

(Developing Method)

The developing method of the present invention comprises:

forming an electrostatic latent image on a photoreceptor; and applying a developing bias to a developing sleeve to develop the electrostatic latent image with the developer of the present invention.

The developer includes the carrier of the present invention and a toner in an amount of 7% by weight. In this case, the toner has an absolute value of the toner charge per unit mass of from 10 to 50 μC/g, and preferably from 15 to 35 μC/g; and a weight average particle diameter of from 3.0 to 9.0 μm, and preferably from 3.0 to 5.0 μm. The distance between the photoreceptor and the developing sleeve is not greater than 0.4 mm, and the developing bias is at least one of an alternating current voltage and a direct current voltage.

The developing method of the present invention can provide high quality images with high image density and good granularity especially in highlight portions without causing the carrier deposition.

When only a direct current voltage is applied as a developing bias, the carrier deposition, edge effect (in that the edge portion of an image has higher image density while the center portion has lower image density), and fog hardly occur in the background. Therefore, the coverage of a toner to a carrier can be increased, and the toner charge per unit mass and the developing bias can be decreased, resulting in increasing the image density.

The developing method of the present invention and the developing device for use in the image forming apparatus of the present invention will be explained in detail.

Figure 7:
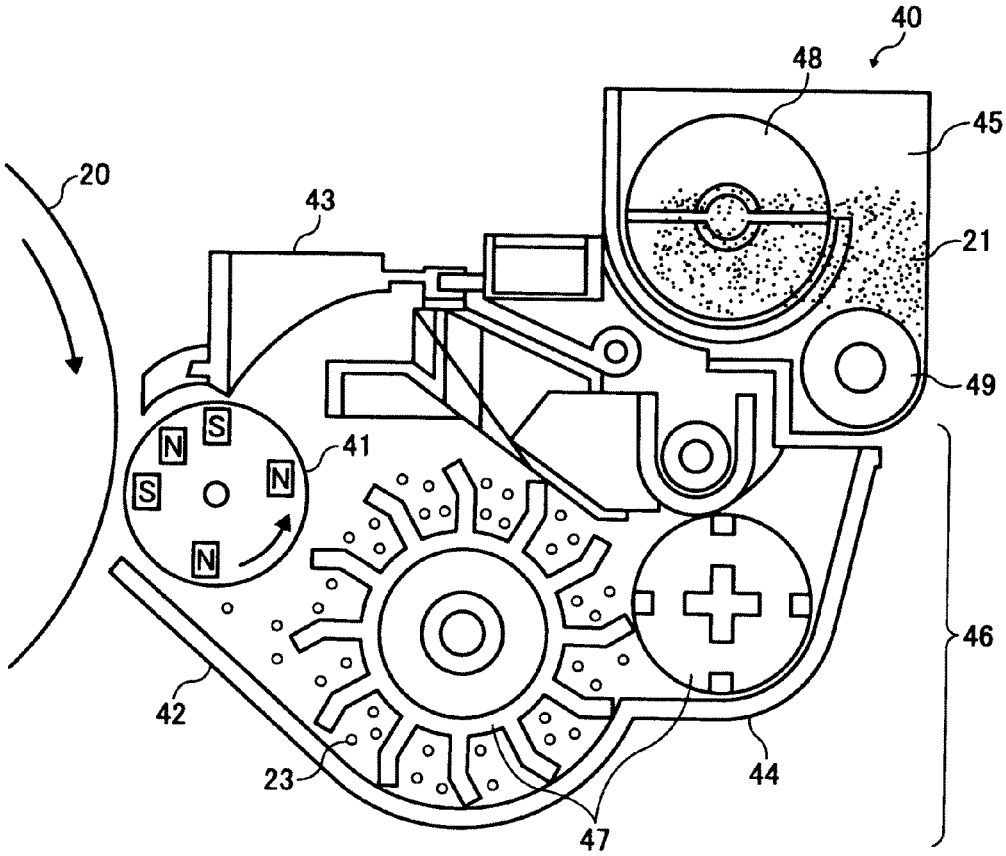
FIG. 7 is a schematic view illustrating an embodiment of a developing device for use in the image forming apparatus of the present invention.

FIG. 7 is a schematic view illustrating an embodiment of a developing device for use in the image forming apparatus of the present invention.

A developing device 40 is arranged so as to face a photoreceptor 20, and includes a developing sleeve 41 serving as a developer bearing member, a developer containing member 42, a doctor blade 43 serving as a control member, and a casing 44.

The casing 44 has an opening on a side facing the photoreceptor 20, and is joined to a toner hopper 45 serving as a toner containing part containing a toner 21. A developer containing part 46, arranged adjacent to the toner hopper 45, contains a developer including the toner 21 and a carrier 23. A developer agitating mechanism 47 configured to give a triboelectric charge to the toner 21 is arranged in the developer containing part 46.

A toner agitator 48 serving as a toner feeding means rotated by a driving means (not shown) and a toner supplying mechanism 49 are arranged in the toner hopper 45. The toner agitator 48 and the toner supplying mechanism 49 supply the toner 21 from the toner hopper 45 to the developer containing part 46 while agitating the toner 21.

The developing sleeve 41 is arranged in a space formed between the photoreceptor 20 and the toner hopper 45, and is rotated by a driving means (not shown) in a direction indicated by an arrow. The developing sleeve 40 internally includes a magnet (not shown) serving as a magnetic field generating means, which does not change the relative position to the developing device 40, so that the carrier 23 forms a magnetic brush thereon.

The doctor blade 43 is attached to the developer containing member 42 on the opposite side to which the casing 44 is attached. A gap is formed between the tip of the doctor blade 43 and the outer surface of the developing sleeve 41.

The developing method of the present invention can be performed by the above developing device as follows, but is not limited thereto.

The toner 21 is fed by the toner agitator 48 and the toner supplying mechanism 49 from the toner hopper 45 to the developer containing part 46, and then agitated by the developer agitating mechanism 47 so as to be triboelectrically-charged to a desired level. The charged toner 21 and the carrier 23 form a developer, and then the developing sleeve 41 bears and transports the developer to a position facing the outer surface of the photoreceptor 20. Only the toner 21 is electrically bound to an electrostatic latent image formed on the photoreceptor 20. Thus, a toner image is formed on the photoreceptor 20.

(Image Forming Apparatus)

Figure 8:
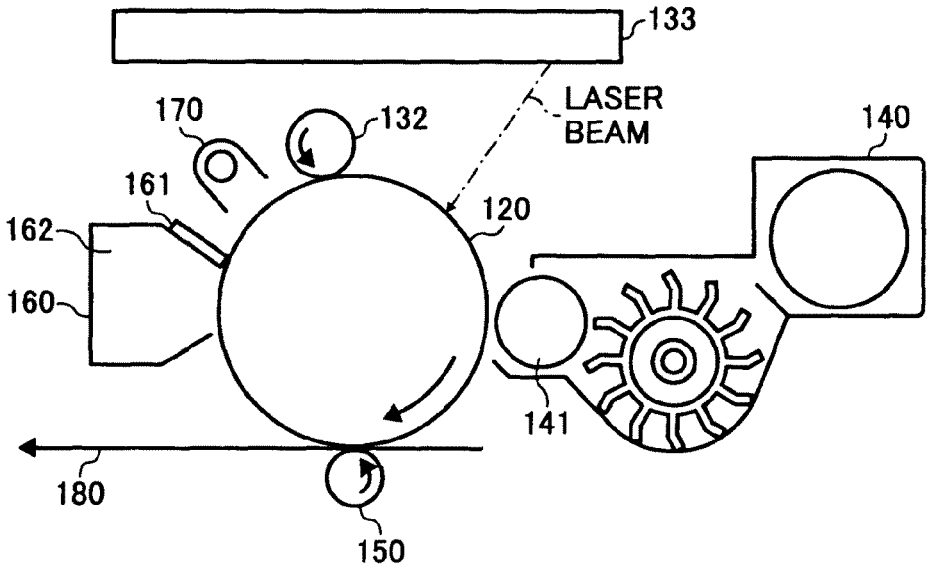
FIG. 8 is a schematic view illustrating an embodiment of the image forming apparatus of the present invention.

FIG. 8 is a schematic view illustrating an embodiment of the image forming apparatus of the present invention.

Around an image bearing member (i.e., photoreceptor) 120, a charging member 132 configured to charge the image bearing member 120, an irradiator 133, a developing device 140, a transfer device 150, a cleaning device 160, and a discharging lamp 170 are arranged. The charging member 132 forms a gap having a distance of about 0.2 mm between the outer surface of the photoreceptor 120. The charging member 132 charges the photoreceptor 120 when an electrical field in which a direct current voltage is overlapped with an alternating current voltage is applied by a bias applying means. Thereby, unevenness of the charging can be reduced.

The image forming method including the developing method of the present invention is performed as follows.

The image bearing member 120, represented by a photoreceptor having an organic photoconductive layer (i.e., OPC), is discharged by the discharging lamp 170, and then uniformly negatively charged by the charging member 132 such as a charger and a charging roller. A laser light beam emitted by an irradiator 133 irradiates the image bearing member 120 to form a latent image thereon. In this case, the absolute value of the potential of the irradiated portion is lower than that of non-irradiated portion.

The laser light beam is emitted by a semiconductor laser, and scans the surface of the image bearing member 120 in a direction of the rotation axis of the image bearing member 120 by a polygon mirror rotating at a high speed, to form a latent image. The thus formed latent image is developed with a developer including a toner and a carrier, which is supplied to the developing sleeve 141, to form a toner image. When the latent image is developed, a developing bias, having a specific voltage or that overlapped with an alternating current voltage, is applied to the developing sleeve 141 and the irradiated and non-irradiated portion of the image bearing member 120 from a bias applying mechanism.

On the other hand, a transfer medium 180 (such as paper) is fed from a paper feeding mechanism (not shown), and then timely fed by a pair of registration rollers (not shown) to an area formed between the image bearing member 120 and the transfer device 150 so as to meet the tip of the toner image. Thus, the toner image is transferred on the transfer medium 180. It is preferable that a transfer bias having the opposite polarity to the toner charge is applied to the transfer device 150. The transfer medium 180 is then separated from the image bearing member 120. Thus, a transfer image is formed.

Toner particles remaining on the image bearing member 120 are reclaimed by a cleaning blade 161 serving as a cleaning member and contained in a toner reclaim chamber 162.

The reclaimed toner particles may be reused by being transported to the developing part and/or the toner feeding part by a toner recycling means.

The image forming apparatus may include a plurality of the developing devices. In this case, each of the toner images is transferred onto a transfer medium one by one. The transfer medium is transported to the developing device, and then the toner image is fixed thereon by applying a heat thereto.

Further, the toner images may be at once transferred onto an intermediate transfer member, and then transferred onto a transfer medium and fixed thereon.

Figure 9:
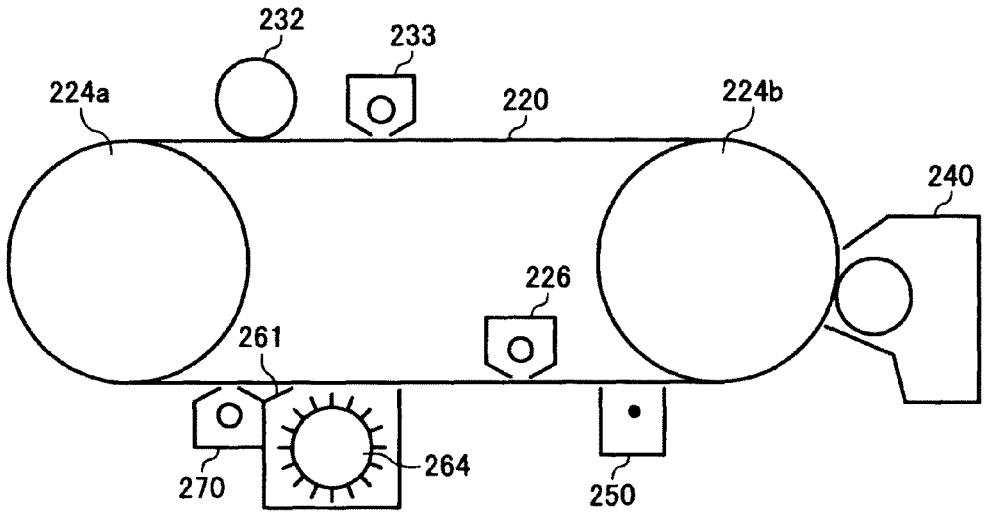
FIG. 9 is a schematic view for explaining the developing method of the present invention.

FIG. 9 is a schematic view for explaining another example of the developing method of the present invention.

A photoreceptor 220 includes a conductive substrate and a photosensitive layer located overlying the conductive substrate, and is driven by driving rollers 224*a* and 224*b*. The photoreceptor 220 is charged by a charging roller 232, and then irradiated by a light source 233 to form an electrostatic latent image thereon. The electrostatic latent image is developed by a developing device 240, and then transferred by a charger 250. The photoreceptor 220 is irradiated by a light source 226 before being cleaned, cleaned by a brush cleaning means 264 and a cleaning blade 261, and discharged by a discharging lamp 270. These processes are repeatedly performed. In FIG. 9, the light source 226 irradiates the photoreceptor 220 from the substrate side. In this case, the substrate is translucent.

(Process Cartridge)

The process cartridge of the present invention comprises:

a photoreceptor configured to bear an electrostatic latent image;

a charging brush configured to charge the photoreceptor;

a developing device configured to develop the electrostatic latent image with the developer of the present invention; and a cleaning blade configured to remove toner particles remaining on the photoreceptor.

Figure 10:
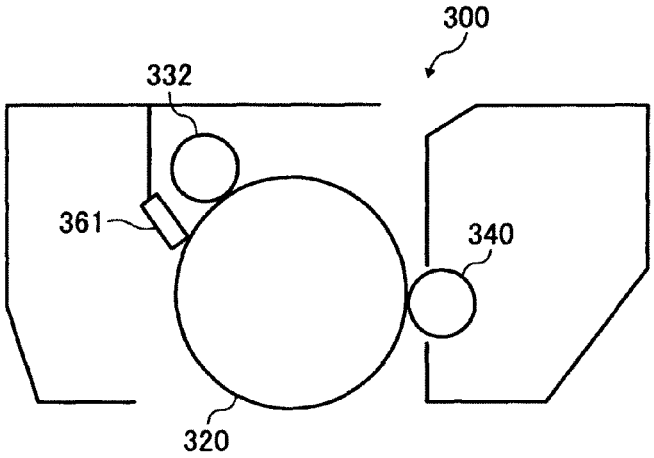
FIG. 10 is a schematic view illustrating an embodiment of the process cartridge of the present invention.

FIG. 10 is a schematic view illustrating an embodiment of the process cartridge of the present invention.

A process cartridge 300 uses the carrier of the present invention and integrally supports a photoreceptor 320, a brush contact charging means 332, a developing means 340, and a cleaning blade 361 serving as a cleaning means. The process cartridge 300 is detachably attachable to an image forming apparatus such as a copier and a printer.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Toner Manufacturing Example 1

The following components are mixed using a blender.

| | |
|---|---|
| Polyester resin | 100 parts |
| Quinacridone magenta pigment | 4 parts |
| Quaternary ammonium salt containing fluorine | 4 parts |

The mixture is melt-kneaded by a double-axis extruder, and then coarsely pulverized by a cutter mill and finely pulverized by a jet stream pulverizer. The pulverized particles are classified using a wind power classifier. Thus, mother toner particles (i) having a weight average particle diameter of 6.8 μm are prepared.

Next, 100 parts of the mother toner particles are mixed with 0.8 parts of a hydrophobized silica (R972 from Nippon Aerosil Co., Ltd.) using HENSCHEL MIXER.

Thus, a toner (I) is prepared.

Toner Manufacturing Example 2

The procedure for preparing the mother toner particles (i) is repeated except that the pulverization conditions are changed so that the resultant mother toner particles (ii) has a weight average particle diameter of 4.5 μm.

Next, 100 parts of the mother toner particles (ii) are mixed with 1.2 parts of a hydrophobized silica (R972 from Nippon Aerosil Co., Ltd.) using HENSCHEL MIXER.

Thus, a toner (II) is prepared.

Core Manufacturing Example 1

At first, 50% by mol of $Fe_2O_3$, 25% by mol of CuO, and 25% by mol of ZnO are added to water and subjected to a pulverization using a bead mill so that the pulverized particles have a particle diameter of not greater than 2 μm. Polyvinyl alcohol is added to the slurry obtained above, and the viscosity of the slurry is controlled. Particles are formed from the slurry and dried, and then provisionally sintered for 5 hours at 900° C.

The particles are introduced to a high-temperature mixed gas of acetylene and oxygen having a temperature of from 2,000 to 3,000° C. so as to be spheroidized, and then ferritized by being sintered at 1,150° C. The particles are further classified using a vibrating screen classifier equipped with an ultrasonic oscillator.

On the other hand, a developing device capable of driving alone is prepared by modifying the developing device of a digital full-color multifunctional printer IMAGIO COLOR 4000 (from Ricoh Co., Ltd.). The magnet of the main pole (having a magnetic force of about 1,000 gauss) thereof is replaced with a weak magnet having a magnetic force of 250 gauss.

The above-classified particles are contained in the above-modified developing device, and then the developing device drives for 10 minutes under the following conditions.

Doctor gap: 0.30 mm (distance between developing sleeve and doctor blade)

Linear speed of developing sleeve: 150 mm/sec

As a result, a part of particles are scattered and separated from the position of the main pole having a magnetic force of 250 gauss. Most of these separated particles have large hollows therein.

The remaining particles are classified again using the vibrating screen classifier equipped with an ultrasonic oscillator.

Thus, a core (a), which is a spherical CuZn ferrite, having a Dw of 37.7 μm, a Dw/Dp of 1.23, an SF-1 of 115, an SF-2 of 114, and a magnetization of 54 emu/g, and including core particles satisfying the relationship (1) (i.e., 0.52<(d/D)<1.0) in an amount of 8,000 ppm by number is prepared.

Core Manufacturing Example 2

The procedure for preparation of the core (a) is repeated except that the conditions of the vibrating screen classifier equipped with an ultrasonic oscillator are changed.

Thus, a core (b), which is a spherical CuZn ferrite, having a Dw of 27.6 μm, a Dw/Dp of 1.17, an SF-1 of 115, an SF-2 of 113, and a magnetization of 55 emu/g, and including core particles satisfying the relationship (1) (i.e., 0.52<(d/D)<1.0) in an amount of 7,000 ppm by number is prepared.

Core Manufacturing Example 3

At first, 50% by mol of $Fe_2O_3$, 25% by mol of CuO, and 25% by mol of ZnO are added to water and subjected to a pulverization using a bead mill so that the pulverized particles have a particle diameter of not greater than 2 μm. Polyvinyl alcohol is added to the slurry obtained above, and the viscosity of the slurry is controlled. Particles are formed from the slurry and dried, and then provisionally sintered for 5 hours at 1,000° C.

These particles are pulverized by a dry method so that the particles have a weight average particle diameter Dw of not greater than 3 μm.

The pulverized particles are introduced to a high-temperature mixed gas of acetylene and oxygen having a temperature of from 2,000 to 3,000° C. so as to be spheroidized, and then ferritized by being sintered at 1,150° C. The particles are further classified using a vibrating screen classifier equipped with an ultrasonic oscillator.

In the same manner as in the Core Manufacturing Example 1, the particles are classified with the developing device (i.e., magnetic classification).

The remaining particles are classified again using the vibrating screen classifier equipped with an ultrasonic oscillator.

Thus, a core (c), which is a spherical CuZn ferrite, having a Dw of 27.7 μm, a Dw/Dp of 1.17, an SF-1 of 116, an SF-2 of 113, and a magnetization of 55 emu/g, and including core particles satisfying the relationship (1) (i.e., 0.52<(d/D)<1.0) in an amount of 1,000 ppm by number is prepared.

Core Manufacturing Example 4

The procedure for preparation of the core (b) is repeated except that the provisional sintering is performed for 3 hours at 800° C. The particles not yet being subjected to the spheroidization had a bulk density of 1.83 g/cm$^3$, while these particles of the core (b) had a bulk density of 2.15 g/cm$^3$.

Thus, a core (d), which is a spherical CuZn ferrite, having a Dw of 27.4 μm, a Dw/Dp of 1.18, an SF-1 of 117, an SF-2 of 115, and a magnetization of 55 emu/g, and including core particles satisfying the relationship (1) (i.e., 0.52<(d/D)<1.0) in an amount of 15,000 ppm by number is prepared.

Core Manufacturing Example 5

The procedure for preparation of the core (b) is repeated except that the classification using the vibrating screen classifier equipped with an ultrasonic oscillator is not performed immediately after the particles are ferritized by being sintered at 1,150° C.

Thus, a core (e), which is a spherical CuZn ferrite, having a Dw of 27.5 μm, a Dw/Dp of 1.41, an SF-1 of 114, an SF-2 of 117, and a magnetization of 55 emu/g, and including core particles satisfying the relationship (1) (i.e., 0.52<(d/D)<1.0) in an amount of 7,000 ppm by number is prepared.

Core Manufacturing Example 6

The procedure for preparation of the core (a) is repeated except that the conditions of the classification using the vibrating screen classifier equipped with an ultrasonic oscillator performed immediately after the particles are ferritized by being sintered at 1,150° C. are changed.

Thus, a core (f), which is a spherical CuZn ferrite, having a Dw of 56.9 μm, a Dw/Dp of 1.28, an SF-1 of 115, an SF-2 of 114, and a magnetization of 54 emu/g, and including core particles satisfying the relationship (1) (i.e., 0.52<(d/D)<1.0) in an amount of 7,500 ppm by number is prepared.

Core Manufacturing Example 7

At first, 50% by mol of $Fe_2O_3$, 25% by mol of CuO, and 25% by mol of ZnO are added to water and subjected to a pulverization using a bead mill so that the pulverized particles have a particle diameter of not greater than 2 μm. Polyvinyl alcohol is added to the slurry obtained above, and the viscosity of the slurry is controlled. Particles are formed from the slurry and dried, and then ferritized by being sintered for 5 hours at 1,070° C.

The particles are classified using a vibrating screen classifier equipped with an ultrasonic oscillator.

In the same manner as in the Core Manufacturing Example 1, the particles are classified with the developing device (i.e., magnetic classification).

The remaining particles are classified again using the vibrating screen classifier equipped with an ultrasonic oscillator.

Thus, a core (g), which is a CuZn ferrite, having a Dw of 27.3 μm, a Dw/Dp of 1.18, an SF-1 of 114, an SF-2 of 128, and a magnetization of 55 emu/g, and including core particles satisfying the relationship (1) (i.e., 0.52<(d/D)<1.0) in an amount of 6,500 ppm by number is prepared.

Core Manufacturing Example 8

The procedure for preparation of the core (g) is repeated except that the particles are ferritized by being sintered for 5 hours at 1,250° C., and then pulverized.

Thus, a core (h), which is a CuZn ferrite, having a Dw of 27.7 μm, a Dw/Dp of 1.16, an SF-1 of 132, an SF-2 of 115, and a magnetization of 55 emu/g, and including core particles satisfying the relationship (1) (i.e., 0.52<(d/D)<1.0) in an amount of 6,000 ppm by number is prepared.

Core Manufacturing Example 9

The procedure for preparation of the core (b) is repeated.

Core Manufacturing Example 10

The procedure for preparation of the core (b) is repeated except that the amount of the particles introduced to the high-temperature mixed gas of acetylene and oxygen having a temperature of from 2,000 to 3,000° C. so as to be spheroidized is reduced to half.

Thus, a core (j), which is a spherical CuZn ferrite, having a Dw of 27.4 μm, a Dw/Dp of 1.14, an SF-1 of 105, an SF-2 of 106, and a magnetization of 55 emu/g, and including core particles satisfying the relationship (1) (i.e., 0.52<(d/D)<1.0) in an amount of 7,000 ppm by number is prepared.

Core Manufacturing Example 11

At first, 50% by mol of $Fe_2O_3$, 35% by mol of MnO, 10% by mol of MgO, and 5% by mol of SrO are added to water and subjected to a pulverization using a bead mill so that the pulverized particles have a particle diameter of not greater than 2 μm. Polyvinyl alcohol is added to the slurry obtained above, and the viscosity of the slurry is controlled. Particles are formed from the slurry and dried, and then provisionally sintered for hours at 900° C.

The particles are introduced to a high-temperature mixed gas of acetylene and oxygen having a temperature of from 2,000 to 3,000° C. so as to be spheroidized, and then ferritized by being reduced under nitrogen atmosphere at 1,200° C. The particles are further classified using a vibrating screen classifier equipped with an ultrasonic oscillator.

In the same manner as in the Core Manufacturing Example 1, the particles are classified with the developing device (i.e., magnetic classification).

The remaining particles are classified again using the vibrating screen classifier equipped with an ultrasonic oscillator.

Thus, a core (k), which is a spherical MnMgSr ferrite, having a Dw of 27.4 μm, a Dw/Dp of 1.16, an SF-1 of 114, an SF-2 of 116, and a magnetization of 58 emu/g, and including core particles satisfying the relationship (1) (i.e., 0.52<(d/D)<1.0) in an amount of 6,500 ppm by number is prepared.

Core Manufacturing Example 12

At first, 55% by mol of $Fe_2O_3$ and 45% by mol of MnO are added to water and subjected to a pulverization using a bead mill so that the pulverized particles have a particle diameter of not greater than 2 μm. Polyvinyl alcohol is added to the slurry obtained above, and the viscosity of the slurry is controlled. Particles are formed from the slurry and dried, and then provisionally sintered for 5 hours at 900° C.

The particles are introduced to a high-temperature mixed gas of acetylene and oxygen having a temperature of from 2,000 to 3,000° C. so as to be spheroidized, and then ferritized by being reduced under nitrogen atmosphere at 1,250° C. The particles are further classified using a vibrating screen classifier equipped with an ultrasonic oscillator.

In the same manner as in the Core Manufacturing Example 1, the particles are classified with the developing device (i.e., magnetic classification).

The remaining particles are classified again using the vibrating screen classifier equipped with an ultrasonic oscillator.

Thus, a core (1), which is a spherical Mn ferrite, having a Dw of 27.3 μm, a Dw/Dp of 1.16, an SF-1 of 115, an SF-2 of 116, and a magnetization of 62 emu/g, and including core particles satisfying the relationship (1) (i.e., 0.52<(d/D)<1.0) in an amount of 7,000 ppm by number is prepared.

Core Manufacturing Example 13

At first, $Fe_2O_3$ is added to water and subjected to a pulverization using a bead mill so that the pulverized particles have a particle diameter of not greater than 2 μm. Next, 0.5% by weight of polyvinyl alcohol is added to the slurry obtained above, and the viscosity of the slurry is controlled. Particles are formed from the slurry and dried, and then provisionally sintered for 5 hours at 950° C.

The particles are introduced to a high-temperature mixed gas of acetylene and oxygen having a temperature of from 2,000 to 3,000° C. so as to be spheroidized, and then magnetized by being reduced under nitrogen atmosphere at 1,350° C. The particles are further classified using a vibrating screen classifier equipped with an ultrasonic oscillator.

In the same manner as in the Core Manufacturing Example 1, the particles are classified with the developing device (i.e., magnetic classification).

The remaining particles are classified again using the vibrating screen classifier equipped with an ultrasonic oscillator.

Thus, a core (m), which is a spherical magnetite, having a Dw of 27.7 μm, a Dw/Dp of 1.15, an SF-1 of 114, an SF-2 of 113, and a magnetization of 65 emu/g, and including core particles satisfying the relationship (1) (i.e., 0.52<(d/D)<1.0) in an amount of 6,500 ppm by number is prepared.

Carrier Manufacturing Example 1

A solution of a silicone resin (SR2411 from Dow Corning Toray Co., Ltd.) including solid components in an amount of 5% is prepared.

The above-prepared silicone resin solution is coated on the surfaces of the particles of 5 kg of the core (a) at a rate of 30 g/min in an atmosphere having a temperature of 90° C., and then the core particles are further heated to 230° C. for 2 hours.

Thus, a carrier (A) having a Dw of 38.1 μm, a Dw/Dp of 1.22, a magnetization at 1 KOe of 53 emu/g, an SF-1 of 114, an SF-2 of 113, and a thickness of the cover layer of about 0.30 μm is prepared.

Randomly selected 2,000 particles of the carrier (A) are observed using an X-ray microscope (TUX-3000W) to measure the number and size of hollows present therein.

The number of hollows present in 2,000 particles is 16, and the number of particles satisfying the relationship (1) (i.e., 0.52<(d/D)<1.0) is 8,000 ppm.

Carrier Manufacturing Examples 2 to 13

The procedure for preparation of the carrier (A) is repeated except that the core (a) is replaced with the core (b) to (m). Thus, carriers (B) to (M) are prepared, respectively.

When the carrier (I) is prepared, 10 parts by weight of $H_2N(CH_2)_3Si(OC_2H_5)_3$ are added to the silicone resin solution so as to control the toner charge per unit mass.

The properties of the above-prepared cores are shown in Tables 1-1 and 1-2, and the properties of the above-prepared carriers are shown in Table 2.

TABLE 1-1

| Core Manufacturing Example | Core | Dw (μm) | Dp (μm) | Dw/Dp | Magnetization (emu/g) | SF-1 | SF-2 | Composition |
|---|---|---|---|---|---|---|---|---|
| 1 | a | 37.7 | 30.7 | 1.23 | 54 | 115 | 114 | CuZn ferrite |
| 2 | b | 27.6 | 23.6 | 1.17 | 55 | 115 | 113 | CuZn ferrite |
| 3 | c | 27.7 | 23.7 | 1.17 | 55 | 116 | 113 | CuZn ferrite |
| 4 | d | 27.4 | 23.2 | 1.18 | 55 | 117 | 115 | CuZn ferrite |
| 5 | e | 27.5 | 19.5 | 1.41 | 55 | 114 | 117 | CuZn ferrite |
| 6 | f | 56.9 | 44.4 | 1.28 | 54 | 115 | 114 | CuZn ferrite |
| 7 | g | 27.3 | 23.1 | 1.18 | 55 | 114 | 128 | CuZn ferrite |
| 8 | h | 27.7 | 23.9 | 1.16 | 55 | 132 | 115 | CuZn ferrite |
| 9 | b | 27.6 | 23.6 | 1.17 | 55 | 115 | 113 | CuZn ferrite |
| 10 | j | 27.4 | 24.0 | 1.14 | 55 | 105 | 106 | CuZn ferrite |
| 11 | k | 27.4 | 23.6 | 1.16 | 58 | 114 | 116 | MnMgSr ferrite |
| 12 | l | 27.3 | 23.5 | 1.16 | 62 | 115 | 116 | Mn ferrite |
| 13 | m | 27.7 | 24.1 | 1.15 | 65 | 114 | 113 | magnetite |

TABLE 1-2

| Core Manufacturing Example | Core | The Number of Hollows per 2000 Particles | The Number of Particles Satisfying 0.52 < (d/D) < 1.0 (ppm by number) |
|---|---|---|---|
| 1 | a | 16 | 8,000 |
| 2 | b | 14 | 7,000 |
| 3 | c | 2 | 1,000 |
| 4 | d | 30 | 15,000 |
| 5 | e | 14 | 7,000 |
| 6 | f | 15 | 7,500 |
| 7 | g | 13 | 6,500 |
| 8 | h | 12 | 6,000 |
| 9 | b | 14 | 7,000 |
| 10 | j | 14 | 7,000 |
| 11 | k | 13 | 6,500 |
| 12 | l | 14 | 7,000 |
| 13 | m | 13 | 6,500 |

TABLE 2

| Carrier Manufacturing Example | Core | Carrier | Dw (μm) | Dp (μm) | Dw/Dp | Magnetization (emu/g) | SF-1 | SF-2 |
|---|---|---|---|---|---|---|---|---|
| 1 | a | A | 38.1 | 31.2 | 1.22 | 53 | 114 | 113 |
| 2 | b | B | 27.9 | 24.1 | 1.16 | 54 | 116 | 114 |
| 3 | c | C | 28.0 | 24.2 | 1.16 | 54 | 115 | 114 |
| 4 | d | D | 27.7 | 23.7 | 1.17 | 54 | 116 | 115 |
| 5 | e | E | 27.8 | 21.1 | 1.40 | 54 | 113 | 116 |
| 6 | f | F | 57.3 | 45.1 | 1.27 | 53 | 114 | 115 |
| 7 | g | G | 27.6 | 23.6 | 1.17 | 54 | 113 | 129 |
| 8 | h | H | 27.9 | 23.9 | 1.17 | 54 | 131 | 113 |
| 9 | b | I | 27.9 | 24.0 | 1.16 | 54 | 116 | 114 |
| 10 | j | J | 27.7 | 24.5 | 1.13 | 54 | 104 | 105 |
| 11 | k | K | 27.8 | 24.1 | 1.15 | 57 | 116 | 115 |
| 12 | l | L | 27.6 | 24.1 | 1.15 | 61 | 114 | 114 |
| 13 | m | M | 28.1 | 24.2 | 1.16 | 64 | 113 | 114 |

Example 1

At first, 93 parts of the carrier (A) and 7 parts of the toner (I) are mixed using a ball mill for 20 minutes. Thus, a developer (1) having a toner concentration of 7.0% by weight is prepared. The toner (A) had a toner charge per unit mass of −23 μC/g.

The developer (1) is subjected to the following evaluations.

The evaluation results of the developer (1) areas follows.

| | |
|---|---|
| Image density: | 1.68 |
| Fog in Background: | Rank 8 |
| Granularity: | Rank 7 |
| Carrier deposition: | Rank 7 |

Fog in background after 50K running test: Rank 8

Examples 2 to 8 and Comparative Examples 1 to 7

The procedure for preparation of the developer (1) is repeated except that the toner and carrier composition is changed to those described in Table 3.

Thus, developers (2) to (8) and comparative developers (C1) to (C7) are compared.

Evaluation

Each of the developers is set in a multifunctional printer IMAGIO COLOR 4000 (from Ricoh Co., Ltd.), and images are produced under the following developing conditions.

Developing gap: 0.35 mm (distance between photoreceptor and developing sleeve)

Doctor gap: 0.65 mm (distance between developing sleeve and doctor blade)

Linear speed of photoreceptor: 200 mm/sec (linear speed of developing sleeve/linear speed of photoreceptor=1.80)

Imprinting density of dots (pixels): 600 dpi

Charged electric potential (Vd): −600 V

Electric potential (Vl) in solid image area: −150 V

Developing bias potential: direct current voltage of −500 V/alternating current bias of 2 kHz, −100 to −900 V, and 50% duty (1) Image Density A solid image having an area of 30 mm×30 mm is produced. Image densities of 5 randomly selected portions in the center of the image are measured using a spectrophotometer X-Rite 938, and the average value is calculated.

(2) Fog in Background

The number of toner particles adhered to the background (i.e., non-image portion) of an image formed on a transfer paper is counted, and converted into the number of toner particles adhered to 1 $cm^2$ of area.

The fog in the background is classified into the following 10 ranks based on the number of toner particles adhered to 1 $cm^2$ of area. The greater, the better, and a rank 10 is the best.

Rank 10: 0 to 36 pcs/$cm^2$

Rank 9: 37 to 72 pcs/$cm^2$

Rank 8: 73 to 108 pcs/$cm^2$

Rank 7: 109 to 144 pcs/$cm^2$

Rank 6: 145 to 180 pcs/$cm^2$

Rank 5: 181 to 216 pcs/$cm^2$

Rank 4: 217 to 252 pcs/$cm^2$

Rank 3: 253 to 288 pcs/$cm^2$

Rank 2: 289 to 324 pcs/$cm^2$

Rank 1: 325 or more pcs/$cm^2$ (3) Granularity

The granularity is defined as the following equation (at a range of lightness of from 50 to 80):

$$G=\exp(aL+b)\int\{WS(f)\}^{1/2}VTF(f)df$$

wherein G represents a granularity, L represents an average lightness, f represents a spatial frequency (cycle/mm), WS(f) represents a power spectrum of a lightness variation, VTF(f) represents visual spatial modulation transfer function, and a and b each represent a coefficient.

The granularity is classified into 10 ranks as follows. The greater, the better, and a rank 10 is the best.

Rank 10: −0.10 to 0

Rank 9: 0 to 0.05

Rank 8: 0.05 to 0.10

Rank 7: 0.10 to 0.15

Rank 6: 0.15 to 0.20

Rank 5: 0.20 to 0.25

Rank 4: 0.25 to 0.30

Rank 3: 0.30 to 0.40

Rank 2: 0.40 to 0.50

Rank 1: 0.05 or more

Figures 11, 12:
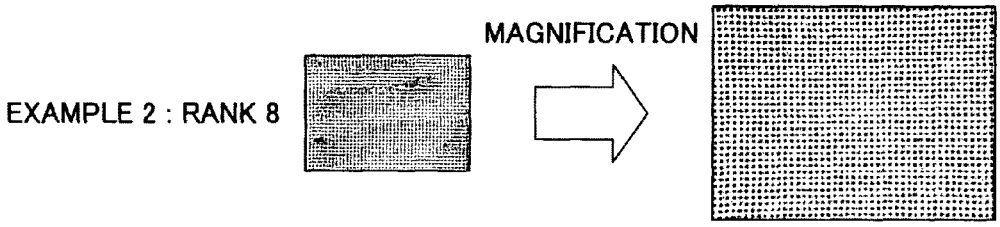
FIG. 11 is an image of examples for evaluating the level of granularity of the produced images.
FIG. 12 is an image obtained in Example 2 having a granularity rank of 8.

In FIG. 11, image examples having the above ranks at a lightness of 65 are illustrated. In FIG. 12, an image obtained in Example 2 having a rank of 8 is illustrated.

(4) Carrier Deposition

An image pattern having 2 dot lines (100 lpi/inch) is formed in a sub-scanning direction, and then developed upon application of a direct current bias of 400 V.

Carrier particles deposited on the area between the 2 dot lines are transferred onto an adhesive tape. (This is because not all the carrier particles deposited on the photoreceptor are to be transferred onto a transfer paper (i.e., the resultant image).)

The number of carrier particles deposited on the area (having an area of 100 $cm^2$) are counted, and classified into 10 ranks as follows. The greater, the better, and a rank 10 is the best.

Rank 10: 0 pcs

Rank 9: 1 to 10 pcs

Rank 8: 11 to 20 pcs

Rank 7: 21 to 30 pcs

Rank 6: 31 to 50 pcs

Rank 5: 51 to 100 pcs

Rank 4: 101 to 300 pcs

Rank 3: 301 to 600 pcs

Rank 2: 601 to 1000 pcs

Rank 1: 1000 or more pcs (5) 50K Running Test

A running test in which 50,000 sheets of a character & image chart having an image proportion of 6% are continuously produced is performed while supplying the toner. After the running test, the image is evaluated according to the above paragraphs (1) to (4).

The evaluation results of the developer (1) to (8) and (C1) to (C7) are shown in Tables 3-1 and 3-2.

TABLE 3-1

| | | | Initial properties | | | | |
|---|---|---|---|---|---|---|---|
| Example | Toner | Carrier | Toner Charge per Mass (−μC/g) | Image Density | Fog in Background (Rank) | Granularity (Rank) | Carrier Deposition (Rank) |
| Ex. 1 | I | A | 23 | 1.68 | 8 | 7 | 7 |
| Ex. 2 | I | B | 28 | 1.62 | 8 | 8 | 8 |
| Ex. 3 | I | C | 28 | 1.61 | 9 | 9 | 9 |
| Comp. Ex. 1 | I | D | 28 | 1.60 | 5 | 7 | 4 |
| Comp. Ex. 2 | I | E | 30 | 1.58 | 6 | 7 | 5 |
| Comp. Ex. 3 | I | F | 18 | 1.71 | 6 | 8 | 6 |
| Comp. Ex. 4 | I | G | 29 | 1.60 | 8 | 8 | 8 |
| Comp. Ex. 5 | I | H | 29 | 1.61 | 8 | 8 | 8 |
| Comp. Ex. 6 | I | I | 65 | 1.32 | 5 | 4 | 5 |

TABLE 3-1-continued

| | | | Initial properties | | | | |
|---|---|---|---|---|---|---|---|
| Example | Toner | Carrier | Toner Charge per Mass (−μC/g) | Image Density | Fog in Background (Rank) | Granularity (Rank) | Carrier Deposition (Rank) |
| Ex. 4 | I | J | 26 | 1.65 | 9 | 9 | 8 |
| Ex. 5 | I | K | 27 | 1.63 | 8 | 8 | 8 |
| Ex. 6 | I | L | 28 | 1.62 | 9 | 8 | 9 |
| Ex. 7 | I | M | 30 | 1.59 | 9 | 8 | 9 |
| Ex. 8 | II | B | 32 | 1.56 | 8 | 9 | 8 |

TABLE 3-2

| | | | Properties after 50K running test | | | | |
|---|---|---|---|---|---|---|---|
| Example | Toner | Carrier | Toner Charge per Mass (−μC/g) | Image Density | Fog in Background (Rank) | Granularity (Rank) | Carrier Deposition (Rank) |
| Ex. 1 | I | A | 22 | 1.66 | 8 | 6 | 7 |
| Ex. 2 | I | B | 29 | 1.62 | 8 | 7 | 8 |
| Ex. 3 | I | C | 29 | 1.63 | 9 | 8 | 9 |
| Comp. Ex. 1 | I | D | 19 | 1.69 | 2 | 2 | 2 |
| Comp. Ex. 2 | I | E | 22 | 1.68 | 3 | 4 | 4 |
| Comp. Ex. 3 | I | F | 16 | 1.76 | 4 | 6 | 7 |
| Comp. Ex. 4 | I | G | 21 | 1.68 | 4 | 6 | 5 |
| Comp. Ex. 5 | I | H | 20 | 1.71 | 4 | 6 | 5 |
| Comp. Ex. 6 | I | I | 55 | 1.36 | 4 | 3 | 4 |
| Ex. 4 | I | J | 27 | 1.65 | 9 | 9 | 9 |
| Ex. 5 | I | K | 26 | 1.65 | 9 | 8 | 8 |
| Ex. 6 | I | L | 26 | 1.63 | 8 | 9 | 8 |
| Ex. 7 | I | M | 28 | 1.61 | 8 | 9 | 8 |
| Ex. 8 | II | B | 28 | 1.60 | 8 | 9 | 8 |

Additional modifications and variations of the present invention are possible in light of the above teachings. It is therefore to be understood that within the scope of the appended claims the invention may be practiced other than as specifically described herein.

This document claims priority and contains subject matter related to Japanese Patent Applications No. 2006-248969 and 2007-215384, filed on Sep. 14, 2006 and Aug. 22, 2007, respectively, the entire contents of which are herein incorporated by reference.

What is claimed is:

1. A carrier, comprising:

a core of magnetic material; and a resin layer located overlying the core, wherein the carrier has a weight average particle diameter (Dw) of from 22 to 50 μm, a ratio (Dw/Dp) of the weight average particle diameter (Dw) to a number average particle diameter (Dp) of from 1.13 to 1.30, a shape factor SF-1 of from 104 to 120, and a shape factor SF-2 of from 105 to 120, wherein the carrier comprises core particles satisfying the following relationship (1) in an amount of from 1,000 to 10,000 ppm by number:

$$0.52<(d/D)<1.0 \quad (1)$$

wherein D (μm) represents a diameter of a circle having the same area as that of a projected image of a core particle and d (μm) represents a diameter of a circle having the same area as that of a projected image of a maximum hollow present in the core particle, and wherein the core is prepared by a method comprising melting a core material and spheroidizing the melted core material in a gas phase.

2. The carrier according to claim 1, wherein the carrier comprises core particles satisfying the relationship (1) in an amount of not greater than 3,000 ppm by number.

3. The carrier according to claim 1, wherein the core comprises a Mn—Mg—Sr ferrite.

4. The carrier according to claim 1, wherein the core comprises a Mn ferrite.

5. The carrier according to claim 1, wherein the core comprises a magnetite.

6. The carrier according to claim 1, wherein the method is selected from the group consisting of a plasma method, a gas burner method, a burning flame gas method, a flame spraying method, a high-frequency plasma method, a hybrid plasma method, and a direct current arc plasma method.

7. A developer, comprising a toner and the carrier according to claim 1.

8. The carrier according to claim 1, wherein the carrier has a shape factor SF-1 of not greater than 110 and a shape factor SF-2 of not greater than 110.

* * * * *